United States Patent [19]

Peery

[11] 4,293,203

[45] Oct. 6, 1981

[54] PHOTOTYPESETTER, METHOD AND APPARATUS

[76] Inventor: Walter E. Peery, 7-74 Pendleton, Londonderry, N.H. 03053

[21] Appl. No.: 114,710

[22] Filed: Jan. 23, 1980

[51] Int. Cl.[3] ..... B41B 17/12

[52] U.S. Cl. ..... 354/17; 354/10

[58] Field of Search ..... 354/5, 7, 9, 10, 13, 354/17

[56] References Cited

U.S. PATENT DOCUMENTS 4,067,022 1/1978 Ebner ..... 354/10

4,116,534 9/1978 McMahon ..... 350/157

OTHER PUBLICATIONS

"Character Selection and Positioning", Chang and Lipp, pp. 1244 & IBM Technical Disclosure Bulletin, vol. 11, No. 10, Mar. 1969.

"Helical Light Scanner for Optical Printing", Fleisher, pp. 1191 & IBM Technical Disclosure Bulletin, vol. 10, No. 8, Jan. 1968.

*Primary Examiner*—Russell E. Adams

*Attorney, Agent, or Firm*—Schiller & Pandiscio

[57] ABSTRACT

A high speed phototypesetter in which a font is selectively illuminated by motor-driven scanning mirrors and scanning motion is cancelled in the reflected image light by mirrors on the same driven shaft or shafts. The image beam from the font is then separated from the illuminating beam and focused at a selected location on a photocomposing surface to provide a focused image of a font character.

9 Claims, 10 Drawing Figures

PHOTOTYPESETTER, METHOD AND APPARATUS

BACKGROUND OF THE INVENTION

1. Field of the Invention

The invention relates to high-speed phototypesetters and particularly to those in which at least one dimension of movement for type selection is determined by movement of the illuminating beam.

2. Relation to the Prior Art

The old time typesetter selected pieces of type and assembled them in a type carrier which was then secured to a printing press, inked and used in printing. Phototypesetting today is more appropriately called photocomposition since the purpose is to provide a photographic image to serve as the basis for making printing plates. This photographic image must have all the desired font styles, sizes, spacings etc. that are to appear in the final print or at least in correct proportion where the final print is to be enlarged or reduced. Today all the photocomposing information is readily fed into a data processing system which can organize it and direct a phototypesetter at high speeds. Transparent type fonts have been arranged on a rotating drum with stationary flash lamps inside the drum. When the selected character came into alignment with the optical system, a flash lamp behind it would be triggered. The speed of such a system is limited by the drum cycle period. Higher speeds have been obtained using cathode ray tube phototypesetters. Cathode ray tube phototypesetters are expensive to manufacture. The cathode ray tube system permits the speed and precision of electronic scanning. The other systems providing the necessary flexibility require mechanical motion with its inherent problems of inertia. U.S. Pat. No. 2,600,168 to Klyce discloses a system similar in many details to the present one. The system does not use a focused image. Instead it uses a "shadowgraph". The shadowgraph technique relies on illumination from a point light source. The two biggest drawbacks to Klyce are the difficulty of providing sufficient illumination from a point source and diffraction problems. Klyce uses sets of orthogonally scanning mirrors to scan a font with the beam traversing each mirror twice so that the scanning motion is cancelled on return. Klyce separates the illuminating and return beams by beam splitters and uses further scanning mirrors to expose his photocomposing surface. Using a point light source and a shadowgraph image, the point light source must be very small and the character must be large. If the character is not very large, diffraction makes any shadowgraph image unusable. The fact that Klyce relies on a shadowgraph image is apparent from his use of a point light source 15 and that the plane of film 44 is located well beyond any focused image plane for characters 10.

SUMMARY OF THE INVENTION

Now, in accordance with the present invention, it has been found that an illuminating beam from a light source of substantial size can be used to selectively illuminate a character in a character font through rotary scanning reflectors which cancel scanning motion in the image beam by returning the image beam via the same reflectors or reflectors on the same driven shafts. The image beam, separated from the illuminating beam, is selectively directed to the photocomposing surface, through an imaging lens which brings an image of the selected character to a sharp focus at the photocomposing surface.

Thus it is an object of the invention to provide a novel phototypesetter which uses orthogonally scanning reflectors and lenses to select a type character and provide a focused image of the character at a photocomposing surface.

It is a further object of the invention to provide a novel phototypesetting method in which a light mask is brought to a focus at a font where it selectively illuminates a character as directed by scanning reflectors, the image beam is then reflected by the same scanning motion to cancel the motion after which the image beam is brought to a sharp focus on an imaging surface.

DESCRIPTION OF THE PREFERRED EMBODIMENT

Figure 1:
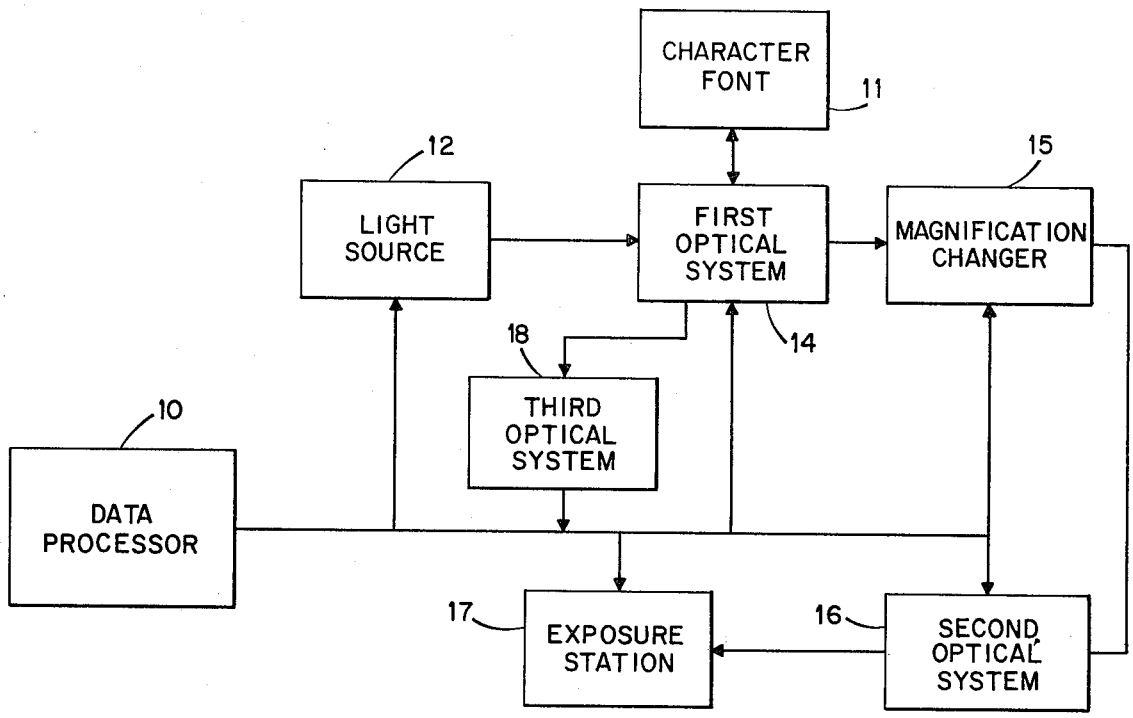
FIG. 1 is a block diagram of a phototypesetting system according to the invention.

FIG. 1 is a generalized block diagram of a phototypesetter as in the invention. Data Processor 10 provides all the commands for a phototypesetting operation. In FIG. 1, data processor 10 connects to each of the other subsystems except character font 11. In embodiments using movement of the character font for one dimension of character selection or for changing the font style or size, data processor 10 may also be connected to the font subsystem. Data processor 10 is programmed and has a memory that is instructed to provide all the commands to the various subsystems necessary for a complete phototypesetting operation. The subsystems in accordance with the invention include light source 12, first optical system 14, magnification changer 15, second optical system 16, exposure station 17 and third optical system 18 as well as character font 11. Light source 12 may take many forms and is preferably a triggered flash lamp such as a Xenon flash lamp with substantial light output in the actinic range for the photosensitive medium used in exposure station 17. A substantial area of a light source may be utilized and accordingly a Xenon arc of 3 mm more or less is suitable. An incandescent filament of similar size may also be used or a larger arc or filament followed by an aperture of about 3 mm diameter. The size of the source or source aperture is only limited by the need of keeping scanning mirrors as small as possible to allow high speed. First optical system 14 takes light from light source 12 and selectively scans character font 11 to provide a light image of a selected character to magnification changer 15.

Magnification changer 15 is of the Zoom Lens type designed to change image magnification without changing focus. Second optical system 16 exhibits the magnified image from the magnification changer 15 and provides the necessary scanning action and focussing to properly direct and focus the character images at exposure station 17 on a suitable photosensitive medium. Third optical system 18 provides position and width data to data processor 10 as sensed from indicia on font 11.

The basic format of the block diagram in FIG. 1 is common to the various embodiments invisioned for the inventive phototypesetter. One preferred embodiment encompasses a special configuration of light source 12, first optical system 14, magnification chamber 15 and second optical system 16 as depicted by optical layout in FIG. 2.

Figure 2:
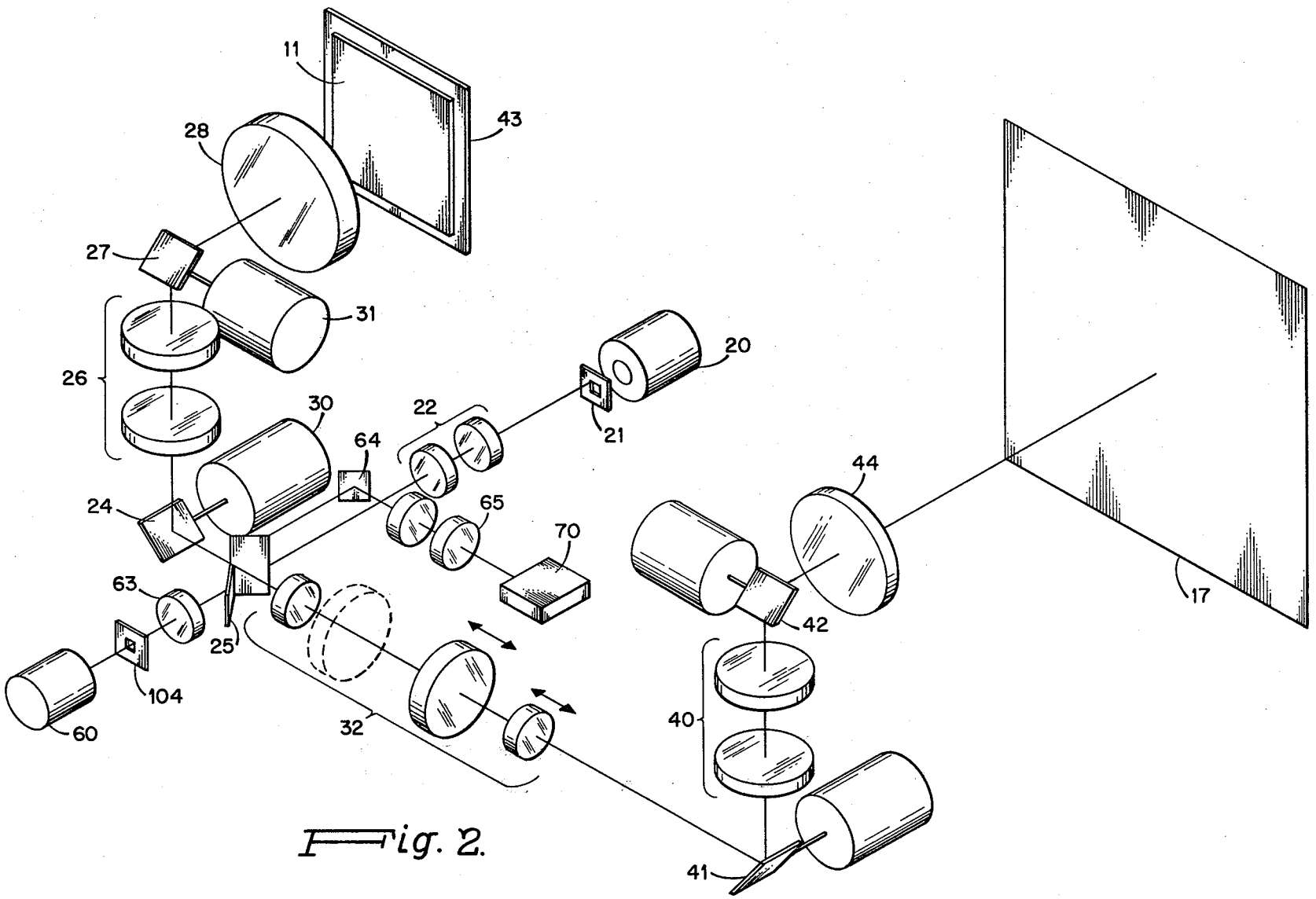
FIG. 2 is a diagrammatic view in perspective of one embodiment of the invention depicting the optical layout.

In FIG. 2, light source 12 is depicted by lamp unit 20. Lamp unit 20 is a Xenon flash lamp with optics to illuminate mask 21. Mask 21 has a rectangular aperture of a size to encompass a character on character font 11. If the mask aperture itself is larger or smaller than the character area to be encompassed, the optics must be selected to correct the size of the mask image as focussed on font 11. One of the purposes of the first optical system is to provide an image of mask 21 at a selected location on font 11. Lens 22, following mask 21 directs light from mask 21 to rotatable reflector 24 providing a focussed image of the arc or arc aperture in lamp unit 20. This keeps the system efficient with mirrors 24 and 27 conveniently small. In between lens 22 and reflector 24 is reflector 25. Reflector 25 is made up of two reflective surfaces positioned substantially at right angles and has one quadrant missing. Two of the remaining quadrants face lens 22 at substantially a 45 degree angle to reflect light from lens 22 onto reflector 24. Reflector 24 reflects the light through relay lens 26 to second rotatable reflector 27. Reflector 27 in turn reflects light received from lens 26 through font lens 28 onto font 11. Font 11 and the rotating axis of reflector 27 are in the two focal planes of lens 28. Lens 26 is designed and located to transpose the focal plane of reflector 24 to reflector 27 and vice-versa.

Reflector 24 is driven by motor 30 to provide a horizontal scanning motion at font 11. Both reflectors 24 and 27 are optical scanners of a type available from General Scanning, Inc. of Watertown, Mass., under the model designation G-100PD. Reflector 27, driven by its associated motor 31, provides vertical scan of font 11. So that reflectors 24 and 27 do not have to occupy the same position, relay lens 26 transposes the focal plane of one of reflectors 24 and 27 to the other. Light modulated by the illuminated character on font 11 passes back through the same optical components so that reflectos 27 and 24 cancel the vertical and horizontal scanning motion respectively. The optical layout is arranged so that the illuminating beam strikes font 11 at a very small angle off normal. This deviation is arranged so that when the reflected beam arrives back at reflector 25 it is on the other side of the right angle, symmetrically positioned with the original illuminating beam relative to the central optical axis of system 14 and passing through the missing quadrant of reflector 25. The reflected beam between lens 26 and reflector 25 is collimated. The deviation can be effected by laterally offsetting mask 21 together with lens 22 or other suitable means. Following reflector 25 is sizing lens system 32. Lens system 32 is suitably an afocal zoom lens having at least two optical elements that move in an asymmetrical manner for changing the magnification while maintaining constant focus. Second optical system 16 of FIG. 1 is shown in FIG. 2 by relay lens 40, rotatable reflectors 41 and 42 and imaging lens 44.

Magnification changer 32 directs the beam to a point at the rotational center of reflector 41. Reflector 41 is a scanning mirror driven as are reflectors 24 and 27 and provides horizontal scan motion for character positioning at exposure station 17. Relay lens 40 is designed and located to transpose the focal plane of reflector 41 or 42 from one to the other. Reflector 42, driven in similar manner to reflector 41, provides vertical scan motion for character positioning at exposure station 17. The vertical scan function of reflector 42 can be eliminated if line separation is provided entirely by movement of the photosensitive medium at exposure station 17. The optical vertical scan is capable of greater speed and allows for reproduction of noncharacter images such as pictures.

In FIG. 2, the optical axis of first optical system 14 is divided into four quadrants. The arrangement and function of these quadrants is better understood with reference to the simplified optical diagram of FIG. 3. The four quadrants are depicted in a cross section of the optical path between reflectors 25 and 24 and designated sequentially quadrants 51, 52, 53, and 54. Reflector 25 has first side 56 facing quadrants 51 and 52 at substantially a 45 degree angle.

Mask 21 and lens 22 are arranged off-axis so that light from source 20 reflects from side 56 of reflector 25 to pass through quadrant 51 such that light reflected from font 11 passes also off-axis through quadrant 53. Considering the dimensions of the components, the off-axis position of the beam is kept as small as possible with respect to the optical axis and the beams passing through all quadrants are substantially parallel. For the purpose at hand, the angle of the incidence and reflection at font 11 may be in the range of one to three degrees.

The portion of reflector 25 that would face quadrant 53 of lens 26 is missing so that light passing through quadrant 53 continues to magnification changer 32.

Figure 3:
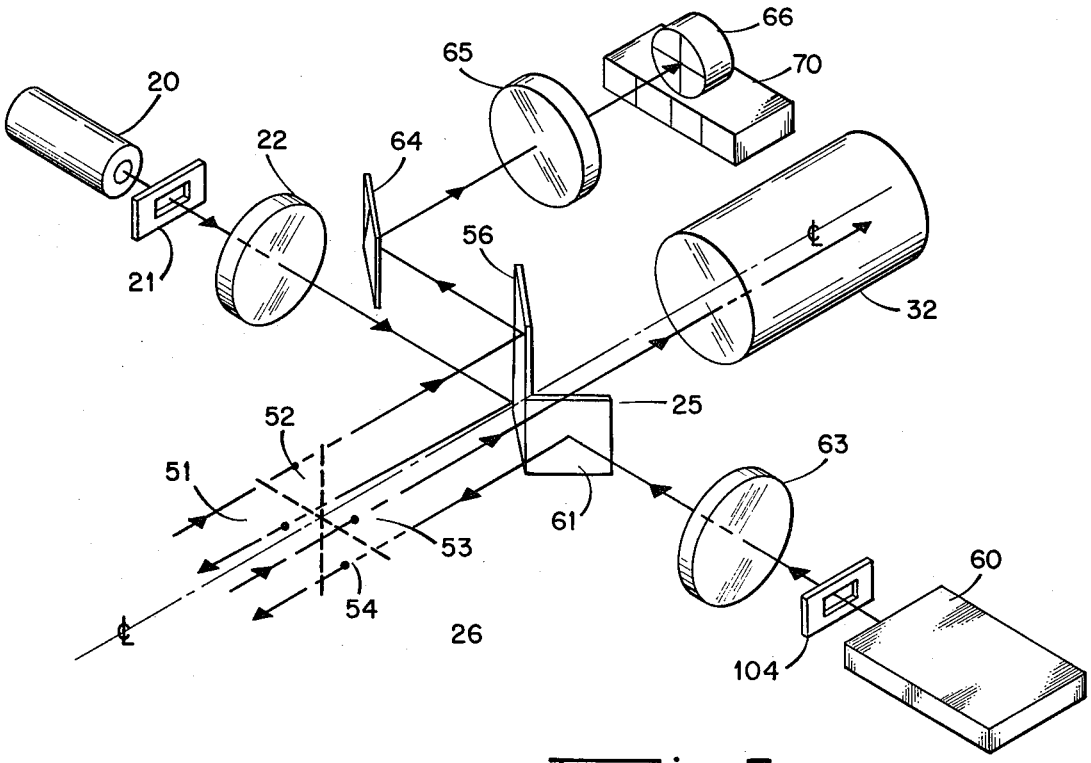
FIG. 3 is a detail from FIG. 2 showing allocation of optical axes.
Figure 4:
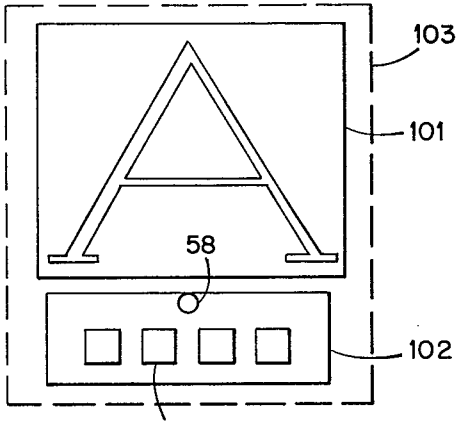
FIG. 4 is a front elevation of a character location in font 11.

As depicted in FIGS. 2 and 3, an additional optical system is preferably combined in first optical system 14. The scanning motors for reflectors 24 and 27 cannot readily attain high position precision without some form of feedback. Feedback information can be provided as depicted in FIG. 4 by having reflective dot 58 positioned under the center of each character of font 11.

Continuous light from source 60 is reflected by side 61 of reflector 25, which faces quadrant 54 at an angle of substantially 45 degrees. The alignment of source 60 and side 61 are such that light from source 60 passes through quadrant 54 off center with respect to the optical axis so that upon reflection at font 11, it returns through diagonally opposite quadrant 52.

This light path is essentially similar to the path used by light from source 20, but using the remaining two quadrants of the optical path. Light passing through quadrant 52 reflects from side 56 of reflector 25 and then from further reflector 64 to be focused by lens 65 on quadrant sensor 66. Quadrant sensor 66 is made up of four light sensors that provide electrical outputs proportional to the illuminating light. The outputs of quadrant sensor 66 are differentially amplified and processed through data processor 10 to provide correction signals for scanner motors 30 and 31. When the output from each quadrant is the same, it indicates the illuminating beam is aligned on the selected character and data processor 10 provides an enabling signal for triggering light source 20. As depicted in FIGS. 3 and 4, light source 60 may be used to provide a further function. Instead of having data processor 10 store memory information as to character widths for each position on each font used, a character width code, for example 4 digits, can be provided. The width code can be reflective spots 68 beneath alignment spot 58 (FIG. 4). Four-element sensor 70, below quadrant sensor 66, would provide outputs to data processor 10 to give width information. This in turn would be used to data processor 10 in controlling the scan operation of reflector 41.

Magnification changers suitable for use as magnification changer 32 are known in the art. A typical type that will maintain the necessary focus has a first lens that is stationary and two further lenses that are moved at different rates by Cams. So that data processor 10 can control magnification, the Cams may be motor driven.

In operation, data processor 10 must be provided with the necessary instructions for a typesetting operation. Data processor 10 begins by driving motors 30 and 31 to illuminate the first character. Upon centering on the first character, light source 20 is triggered. As an alternative, light source 20 may be triggered at a periodic rate determined to allow for positioning time and interruptable for magnification changes, frame changes and other events that would require greater time intervals than character sequencing.

The light beam is shaped by mask 21 and reflects from reflector 25 to reflector 24. Reflector 27 following lens 26 directs the beam through lens 28 to reflective font 11. Reflectors 24 and 27 direct the beam to a selected character on font 11 through lens 28.

The character in font 11 (preferably specularly reflective) reflect in character configuration back to reflector 25. Offsetting the illuminating beam causes the reflected light to pass through quadrant 53 and through the open part of reflector 25 to magnification changer 32. On this return path, reflectors 27 and 24 cancel out the beam movement that provided for font illumination. Following magnification changer 32, the character is finally imaged on photosensitive material at exposure station 17 being selectively directed by rotatable mirrors 41 and 42 on either side of relay lens 40. Lens 44 focuses the character image to a sharp focus at the exposure station.

Position sensing at font 11 is desirable even with extremely accurate scanning motors. This reduces the need to rely on high precision fonts and high accuracy of font position.

The same problems do not apply at exposure station 17 where position sensing feedback is not illustrated. If desired however, a technique for position sensing useful at exposure station 17 is known. The technique reflects light off the back of the scanning reflectors to sense the reflector positions and generate feedback information.

Font 11 is suitably a plate having a highly reflective surface which is originally coated with a nonreflective masking layer. The masking layer is etched away in the character configuration and to provide position spots and width codes.

Figure 7:
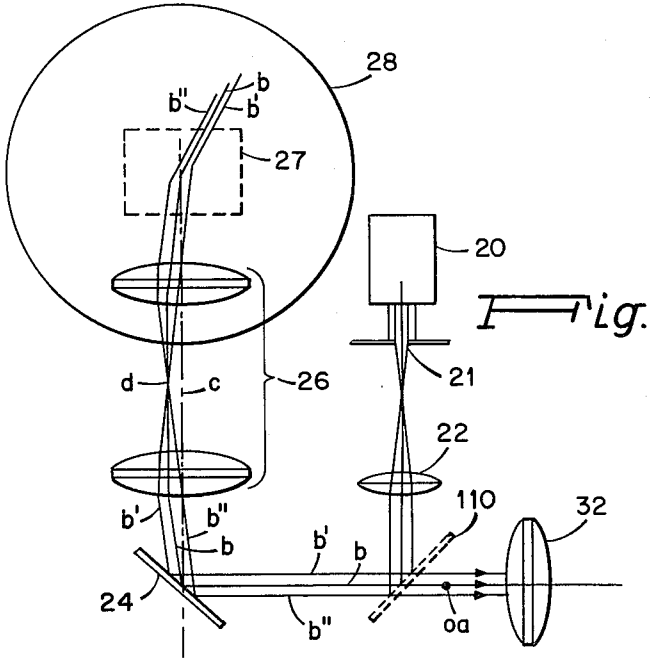
FIGS. 5, 6 and 7 are ray path diagrams of the first optical system.
Figure 6:
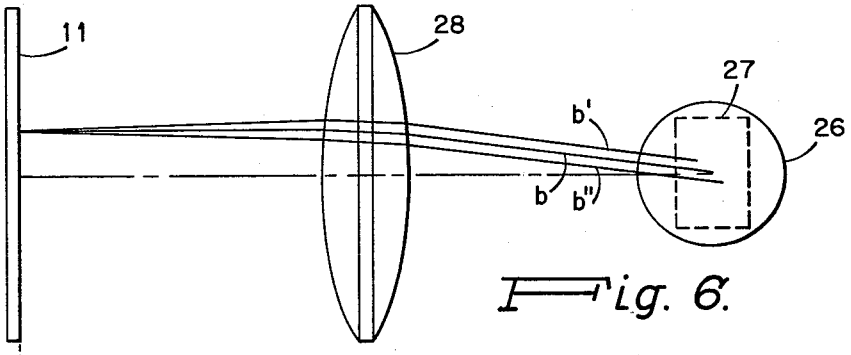
Figure 5:
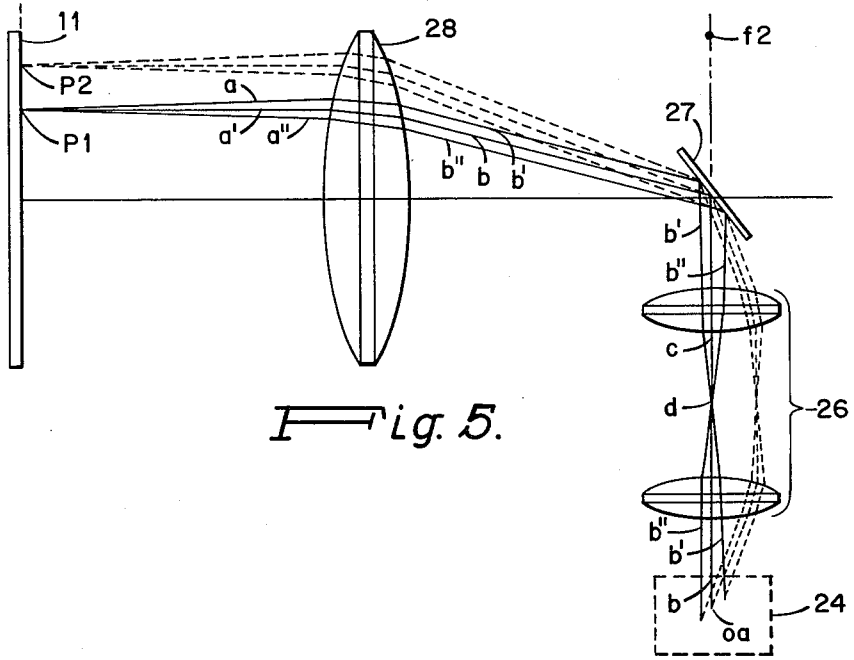

FIGS. 5 through 9 together with the following description cover the theory of the optical system. FIGS. 5, 6 and 7 relate to FIG. 2 and use the same reference numbers where applicable. FIGS. 5, 6 and 7 show in detail the ray paths from a point P1 in the focal plane of font lens 28 to sizing lens system 32. Font plate 11, with alphanumeric characters in orthogonal modular arrangement, is located in one focal plane, F1, of font lens 28. A typical character module is illustrated in FIG. 4. Total module 103 consists of a character area 101 and a code area 102. The light from each point, such as point P1 on the character will produce light rays such as the rays a-a′-a″ which will emerge from lens 28 as parallel or collimated rays b-b′-b″. There will be an infinite number of light emitting points on the character, point P2 illustrating one such other point.

The rays from some other point P2 emerging from lens 28 will be parallel with respect to each other but not parallel to rays b-b′-b″. Thus the total beam consists of bundles of parallel rays in which the bundles are not parallel to each other. By preferred definitions the total beam is a collimated beam although all rays are not parallel.

The character is ineffect made up of an infinite number of light emitting points and the light from each is operated on by the optical system in the same manner. Therefore, only one point P1 need be considered, it being understood that there are an infinite number of such points and their light will propagate through the optical system in a similar way although not by the same identical routes because their angle of emergence from lens 28 differs.

It is not essential that lens 28 be positioned at its focal distance from font 11. If it is not, the total beam will not be collimated. If the total beam is collimated, small positional drifts of the optics will have no affect on the final image at the exposure station. If the beam is not collimated, such drifts will affect focus and/or position at the exposure station.

Rotatable reflector 27 (FIG. 5) is positioned with its axis generally in the other focal plane, F2, of lens 28. This mirror directs emerging light rays b-b′-b″ into relay lens system 26 and thence to rotatable reflector 24 which directs the rays along principal optical axis OA.

It is desirable for optical efficiency but not essential that the optical axis of font lens 28 and optical axis C of the relay lens system intersect at the axis of rotation of mirror 27. Essentially, the relay lens causes the collimated light beam b-b′-b″ to be reproduced although inverted at mirror 24.

While the relay lenses are shown as double lenses in which a character image plane would be formed between the two lens components, this is not necessary and system costs are greatly reduced by using a single element lens for lenses 26 and 40. A character image plane is then formed at a location that can be expected to be closer to reflector 24 than reflector 27. Using a single element relay lens results in focussing a character image from the combined action of font lens 28 and relay lens 26. Thus the image beam is no longer collimated. With the more complex relay lens 26, the second half of the lens system recollimates the image beam. With the single element relay lens, a collimating lens positioned its focal length from the character image will recollimate the image beam. Since this collimating lens will be positioned on the beam axis OA after the scan movement has been cancelled, it will be a much less expensive lens that required between reflectors 24 and 27 for the same function.

Relay lens 26 can also be omitted. This requires keeping the various beams of light small and close together at mirrors 24 and 27 in order to keep mirrors 24 and 27 small. In order to eliminate the relay lens, the scanning reflectors have to be moved away from the focus of the light source so as to allow both reflectors 24 and 27 to be adjacent the focus of the light source. Actually this imposes significantly greater requirements on mirrors 24 and 27 and on magnification changer 32 such that use of relay lens 26 is preferred.

Mirror 24 directs the beam along principal optical axis OA towards mirror 25 and magnification changer 32 as illustrated in FIG. 2. Thus mirrors 27 and 24 direct each character beam, from a sequence of characters illuminated at font 11, along the common optical axis OA.

If beam splitting reflector 110 of FIG. 7 is inserted in the light beam between reflector 24 and magnification changer 32, a portion of the light from the reflector 24 will pass through to magnification changer 32.

It is to be born in mind that this decription of operation uses a beam splitter rather than off center beams only for simplification. All the other features described apply to the embodiment of FIGS. 2 and 3 also.

If a light beam is directed to the beam splitting reflector, part of its energy will be directed toward reflector 24 and will cause point P1 to be illuminated. That is, the illuminating light and the reflected light will follow the same optical path. By this process, any desired character on font 11 can be illuminated and its reflected imaging beam will be transmitted back through the same optical system at the same time. Reflectors 24 and 27 need only be adjusted to the required positions.

Referring again to FIG. 7, if a character on font 11 is to be illuminated, then light source 20 will illuminate mask aperture 21 which is in the focal plane of lens 22. The light from mask aperture 21 is introduced into the optical system by beam splitter 110. It is directed toward reflector 24, through relay lens 26, and reflector 27 to lens 28 which then images the mask as a rectangular area of light on font plate 11. This beam illuminates only the character area 101 of the character module of FIG. 4. The image of the aperture 21 on the font plate is a sharply focused rectangle of light of the same size as one character module so that only one character at a time may be illuminated.

The light is both transmitted to and received from the selected character over the same path. The output of magnification changer 32 is directed to reflector 41, (FIG. 2) thence to relay lens system 40, then to reflector 42 and to lens 44. Lens 44 focuses the beam onto photosensitive surface 17.

An alternate method of illuminating the desired character module on font 11 has been devised which elminates the inefficiency of a beam splitter for introducing the illumination as was described above.

Figure 8:
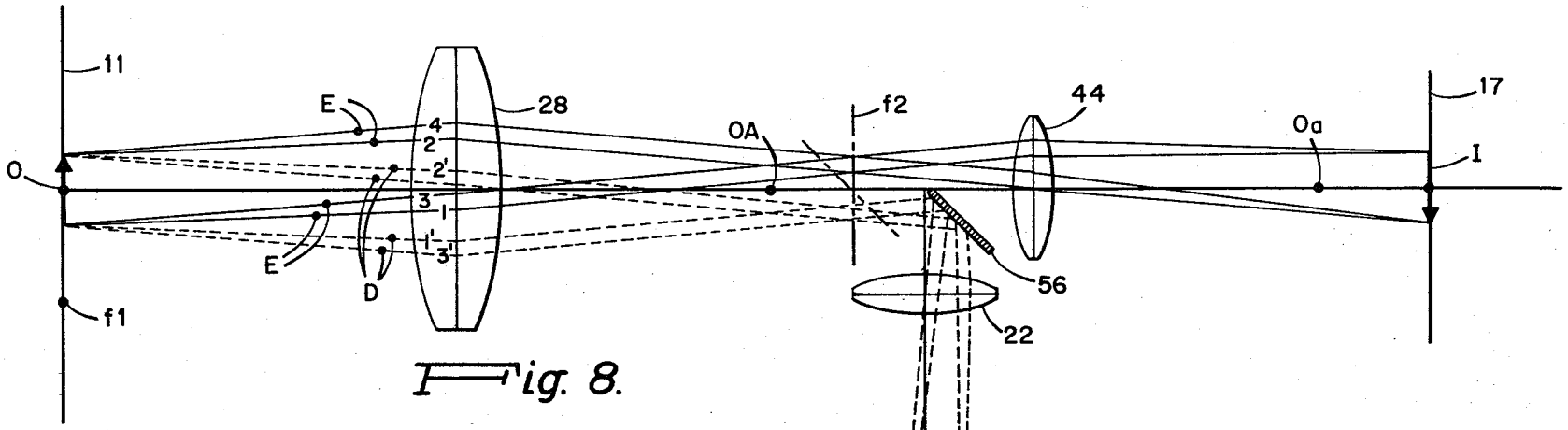
FIGS. 8 and 9 are ray path diagrams of the imaging system with scanning, relay and sizing optics removed.
Figure 9:
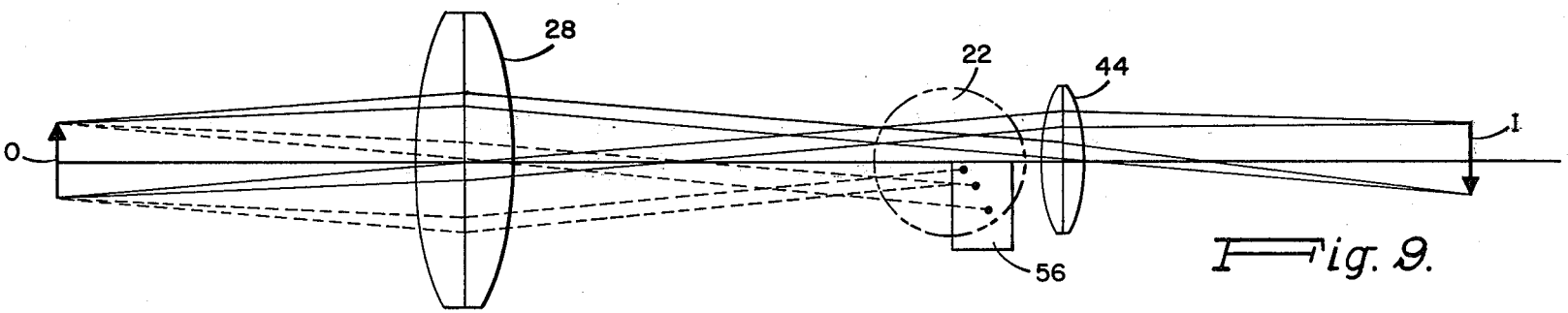

The method is illustrated in FIGS. 8 and 9. These FIGS. show a stripped down optical system in which rotating reflectors, relay lenses and sizing optics have been removed leaving the font matrix 11, font lens 28, imaging lens 44, and imaging surface 17.

It will be understood that the explanation of operation of the optical parts of FIGS. 8 and 9 will apply to the operation of the construction shown in FIGS. 2 and 3.

In FIG. 8, reflector 56 is positioned as shown to receive a beam of light from lens 22. Aperture 21 is located in the focal plane of lens 22. The aperture is illuminated uniformly by a light beam 20. Reflector 56 directs the beam to lens 28 which in turn images aperture 21 onto font 11 in focal plane F1 of lens 28. The object, O, on the focal plane is thus illuminated. Reflector 56 intercepts only one-half of the optical cross section at its location, stopping at the principal optical axis OA rather than extending completely across the optical path. As a result, object O cannot be illuminated by a light beam that converges from all directions but only by the light converging from the lower half of the optical cross-section as indicated by broken ray lines D. These rays are incident on object O at a small angle to the normal as shown.

Light rays E, reflected from O, will be reflected upward at the same small angle as the incident rays D. The reflected light will occupy the upper half of the optical cross section as shown by solid ray lines. If the system is so proportioned, the reflected beam (solid lines) will pass reflector 56 without interference and will produce the image, I, at the focal plane of imaging lens 44. It can be seen that reflector 56 can be introduced at appropriate locations to accomplish its purpose but not at any location.

The area of the optical cross section devoted to the illuminating and reflected beams can be further reduced to diagonal quadrants as illustrated in FIG. 9 which is a side view of FIG. 8. Here, reflector 56 occupies only one quadrant of the beam cross section and so the illuminating beam is angled upward toward the object 0 as well as inward at a compound angle. Thus, two quadrants of the principal optical cross-section are used, one to transmit the illumination to the selected character and the other to transmit the image beam from that character to magnification changer 32.

The remaining two quadrants are used in similar manner to illuminate an image locating spot 58 and width codes 68 (FIG. 4) onto sensors 66 and 70 respectively (FIG. 3). The optical arrangement of the allocation of the quadrants is illustrated in FIG. 3. In this FIG. the beam from lens 22 is reflected by the lower portion of reflector 25 into quadrant 51 of the optical cross-section. This is the beam that illuminates area 101 of FIG. 4, the character area. The reflected beam from this area returns along quadrant 53 and enters the sizing optics 32 as has been previously described.

Additionally, a light source 60, mask 104, and lens 63 create a light beam that is inserted into quadrant 54 by reflector 61. This beam is focused by lens 28 onto the code area 102 of the character module, the focused area being the image of mask 104. The reflected beam from this area code area returns via quadrant 52 and is diverted by reflectors 56 and 64 to lens 65. Lens 65 focuses the image of code area 102 onto sensors 66 and 70.

Figure 10:
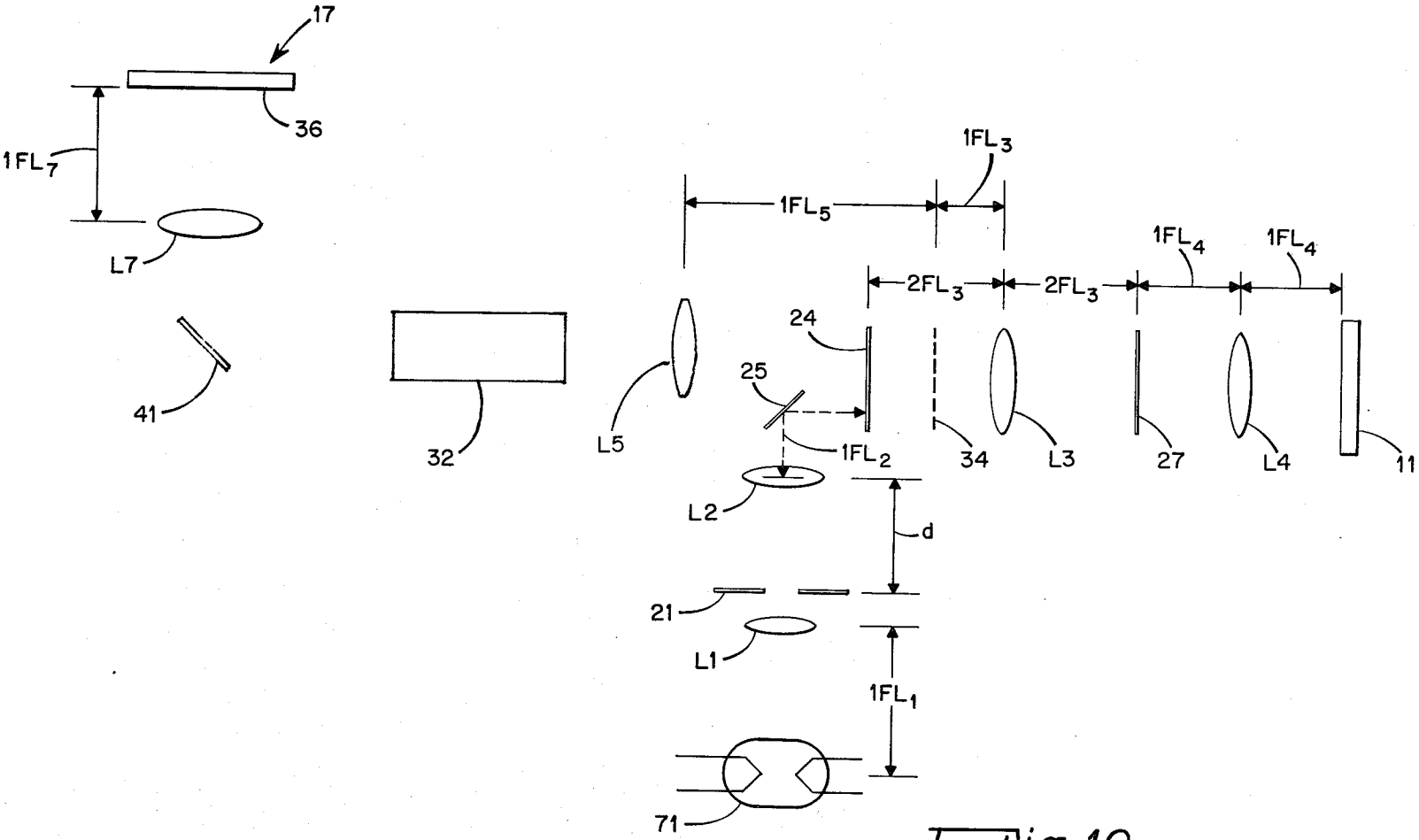
FIG. 10 is a diagram of an optical layout using single lens relay lenses.

FIG. 10 depicts a preferred arrangement of optics for a system using a single element relay lens in the first optical system and scanning in only one direction (horizontal) in the second optical system. For simplicity the third optical system is omitted. Lamp unit 20 is depicted as Xenon arc lamp 71, together with a collimating lens L1. Lens L1 is positioned its own focal length from the arc of arc lamp 71 so as to collimate the light from the arc. Mask 21 is positioned following lens L1, the spacing not being critical. Lens L2 is positioned along the central axis through mask 21. Reflector 25 is positioned to intercept illuminating light from lens L2 and relfect it to scanning reflector 24. The optical path length from lens L2 to reflector 24 is the focal length of Lens L2 so that the arc of lamp 71 is brought to a focus at reflector 24. Lens L3 along the optical axis from reflector 24 is positioned twice its focal length from reflector 24 so as to provide a second focus of the lamp arc at reflector 27, which is positioned in the conjugate plane of lens L3 relative to the plane of reflector 24.

Since the image of the arc is brought to a focus at reflector 27, lens L4 positioned along the optical axis its own focal length from reflector 27 will collimate the image light of the lamp arc. Mask 21 is positioned along the axis of lens L2 at a location to provide its image in sharp focus at font 11. Lens L4 will reproduce the focus image of the aperture of mask 21 on the selected point of font 11.

It will be recognized now that in the light returning (reflected) from font 11, we are no longer interested in the mask aperture but will consider only images of the lamp arc and character images from font 11. Since lens L4 is positioned a focal length from font 11, the image light from font 11 will be collimated by lens L4. On the other hand the arc image of lamp 71 will be reflected as collimated light and brought back to a focus by lens L4 at reflector 27. Lens L3 again serves its relay function and provides an image of the lamp arc at reflector 24 but it will bring the image light from font 11 to a focus at image plane 34 one focal length away from lens L3. Refector 24 cancels out the remaining scanning motion and lens L5 intercepts the imaging beam along a common optical axis which will be unvarying for a succession of characters illuminated at different positions on font 11. Lens L5 is positioned its own focal length from the image of the font character produced by lens L3. Thus lens L5 recollimates the image light.

The reason for keeping the font image light collimated to the extent reasonably possible is that minor lateral or axial misadjustment or movement of the various lenses receiving collimated light has little effect on the focus or position of the final font character image at exposure station 17.

Lens L5 is followed by magnification changer 32. Scanning reflector 41 for horizontal scanning at exposure station 17 follows magnification changer 32. Lens L7 is positioned its own focal length from exposure station 17 so that the collimated image light of font 11 is brought to a sharp focus.

FIG. 10 depicts one way of angling the beams so as to separate the illuminating and imaging beams. Mask 21 and lens L2 have their optical axis displaced by mirror 25 to one side of the optical axis of lenses L3 and L4. This displacement is exagerated in the figure for descriptive purposes. The results are an angling of the illuminating and imaging beams at the font.

While the invention has been described with relation to a specific embodiment, variations are contemplated as within its scope. Various methods of angling the beams to and from font 11 can be used other than displacing the mask system. Instead of angling the beam through the optical system, the input and output beams can follow the same axis using a beam splitter instead of reflector 25. There is no need to divide the first optical system into quadrants. Other divisions can be made. One desirable one is just into halves. The input beam then uses one half and the output beam the other. In this arrangement, the further illuminating system for precision position feedback and width codes can enter and leave the main beam axis by small reflectors located in suitable planes.

In like manner, the vertical scan function of reflector 27 can be eliminated if line to line section of the characters from font matrix 11 is provided by moving the font vertically to present each line of characters to a horizontal scan position.

Other variations and modifications obvious to those skilled in the art are also contemplated as within the scope of the invention, thus it is intended to cover the invention to the full extent of the following claims.

I claim:

1. A method of phototypesetting comprising:

(a) illuminating an aperture to provide an illuminating beam therefrom;

(b) directing said illuminating beam by one or more rotatable reflectors to illuminate a succession of characters on a character font;

(c) optically focusing an image of said aperture on each of said characters;

(d) directing light from each illuminated character back to said one or more reflectors so as to generate an aligned image beam on a common axis for each character of said succession;

(e) disposing a photosensitive medium at an exposure station; and (f) optically directing and focusing said aligned image beam so as to focus images of said succession of characters at selected locations on said medium.

2. A method of phototypesetting comprising:

(a) illuminating an aperture with a light source to provide an illuminating beam therefrom;

(b) directing said illuminating beam by one or more rotatable reflectors to illuminate a succession of characters on a character font at an angle off normal to said character font;

(c) optically focusing an image of said aperture on each of said characters;

(d) directing light from each illuminated character along a common axis so as to form an aligned image beam for each character of said succession, said axis being displaced from said illuminating beam;

(e) disposing a photosensitive medium at an exposure station; and (f) optically directing and focusing said aligned image beam so as to focus image of said succession of characters at selected locations on said medium.

3. A method of phototypesetting according to claim 2 wherein said illuminating beam and said image beam diverge so slightly as to be considered substantially parallel.

4. A method of phototypesetting according to claim 3 wherein said image beam is collimated before and after passing said rotatable reflectors, while an image of said source is brought to a focus substantially at each rotatable reflector.

5. A phototypesetter comprising:

(a) a light source;

(b) a reflective character font;

(c) a first optical system comprising at least one rotatable reflector for directing light from said source to selectively illuminate a succession of characters in said character font, said first optical system including a collimating means for collimating light reflected from each illuminated character and for directing the collimated light as a collimated beam along a common axis;

(d) an exposure station carrying photosensitive material; and (e) a second optical system comprising at least one rotatable refector and an imaging lens for collecting said collimated beam to produce a focussed image at a selected location on said photosensitive material.

6. A phototypesetter according to claim 5 wherein said at least one rotatable reflector is two rotatable reflectors electrically driven around orthogonally related axes to provide two dimensional scanning of said font and said first optical system comprises means for directing light from said source, via each of said rotatable reflectors to provide an illuminating beam and for collecting light reflected by said font and directing it to reflect again at each of said rotatable reflectors to provide an image beam from which scanning motion has been removed.

7. A phototypesetter according to claim 6 wherein a second collimating means in said first optical system is positioned in the path of said image beam after the scanning motion has been removed to produce said collimated beam.

8. In a photo typecomposing machine the combination comprising:

(a) a photosensitive surface to receive a succession of character images;

(b) a lens;

(c) a reflective font of characters in coplanar orthogonal arrangement behind said lens;

(d) an illuminating beam of light provided from a light source;

(e) at least one rotating mirror to direct said beam to illuminate selectively through the lens each character as required in succession;

(f) means to direct an image beam of light reflected from said characters along a path nearly paralled the path of the illuminating beam of light;

(g) means for separating said image beam from said illuminating beam path at a location short of said light source; and (h) means for focussing said image beam to a focused image of each character of said succession on said photosensitive surface.

9. A phototypesetter comprising:

(a) a light source;

(b) a character font;

(c) a first optical system comprising at least one rotatable reflector for directing light from said source to selectively illuminate a succession of characters in said character font at a small angle off-normal to said font and collimating means for producing, along a common axis, a collimated beam of the light reflected by each of the illuminated characters;

(d) an exposure station carrying photosensitive material; and (e) a second optical system comprising at least one rotatable reflector and an imaging lens for collecting said collimated beam to produce a focused image at a selected location on said photosensitive material.

* * * * *

UNITED STATES PATENT AND TRADEMARK OFFICE

CERTIFICATE OF CORRECTION

PATENT NO. : 4,293,203

DATED : October 6, 1981

INVENTOR(S) : Walter E. Peery

It is certified that error appears in the above-identified patent and that said Letters Patent are hereby corrected as shown below:

Claim 2, column 10, line 35, the word "image" should read --images--.

Claim 5, column 10, line 60, the word "refector" should read --reflector--.

Claim 8, column 12, line 2, the word "paralled" should read --parallel--.

Signed and Sealed this

*Fifteenth* Day of *December 1981*

[SEAL]

*Attest:*

GERALD J. MOSSINGHOFF

*Attesting Officer*

*Commissioner of Patents and Trademarks*